US007617874B2

(12) United States Patent
Ocalan

(10) Patent No.: US 7,617,874 B2
(45) Date of Patent: Nov. 17, 2009

(54) FLEXIBLE MATRIX COMPOSITE ACTUATOR FOR USE IN SUBSURFACE WELLBORES

(75) Inventor: Murat Ocalan, Cambridge, MA (US)

(73) Assignee: Schlumberger Technology Corporation, Sugar Land, TX (US)

( * ) Notice: Subject to any disclaimer, the term of this patent is extended or adjusted under 35 U.S.C. 154(b) by 194 days.

(21) Appl. No.: 11/762,298

(22) Filed: Jun. 13, 2007

(65) Prior Publication Data

US 2008/0060801 A1 Mar. 13, 2008

Related U.S. Application Data

(60) Provisional application No. 60/825,158, filed on Sep. 11, 2006.

(51) Int. Cl.
*E21B 34/00* (2006.01)

(52) U.S. Cl. ..... 166/321; 166/66.5; 166/66.6; 166/66.7; 166/319; 166/332.1; 92/34; 92/90; 92/92; 251/61; 251/61.2; 251/61.5; 91/418; 417/416; 417/417; 417/554; 417/555.1

(58) Field of Classification Search ..... 166/66.6, 166/66.7, 319, 321, 332.1, 401; 251/61, 251/61.1, 61.2, 61.5, 63.5, 70; 91/34, 418; 92/34; 60/477; 417/416, 417, 554, 555.1; 137/155

See application file for complete search history.

(56) References Cited

U.S. PATENT DOCUMENTS 2,991,763 A * 7/1961 Marette ..... 91/470
3,319,532 A * 5/1967 Pridham, Jr. ..... 92/34
3,967,809 A * 7/1976 Skantar ..... 251/61
4,108,050 A * 8/1978 Paynter ..... 92/48

(Continued)

FOREIGN PATENT DOCUMENTS

EP 145810 6/1985

(Continued)

OTHER PUBLICATIONS

Shan, Y. and Bakis, C.E., Flexible Matrix Composite Actuators, 20th Annual Technical Conference of the American Society for Composites, Sep. 7-9, 2005, Philadephia, Pennsylvania.*

(Continued)

*Primary Examiner*—Jennifer H Gay
*Assistant Examiner*—Blake Michener
(74) *Attorney, Agent, or Firm*—Jeremy P. Welch; James L. Kurka; Van Someren, PC

(57) ABSTRACT

A valve control system for a wellbore includes a fiber composite actuator functionally coupled to a valve operating member and means for controllably charging an interior of the actuator with fluid under pressure. A valve for a wellbore includes a valve stem and a valve seat associated with a valve body. The valve stem and valve seat are configured to enable fluid flow from an inlet port in the valve body to an outlet port in the valve body when the stem is moved from the seat. An axial contraction fiber composite actuator is functionally coupled to the valve stem. The valve includes means for controllably charging an interior of the actuator with fluid under pressure.

23 Claims, 4 Drawing Sheets

U.S. PATENT DOCUMENTS

| | | | | | |
|---|---|---|---|---|---|
| 4,615,260 | A | * | 10/1986 | Takagi et al. | 92/92 |
| 4,733,603 | A | * | 3/1988 | Kukolj | 92/92 |
| 4,739,692 | A | * | 4/1988 | Wassam et al. | 91/36 |
| 4,751,869 | A | * | 6/1988 | Paynter | 92/92 |
| 4,819,547 | A | * | 4/1989 | Kukolj | 92/261 |
| 4,877,375 | A | | 10/1989 | Desjardins | |
| 6,067,892 | A | * | 5/2000 | Erickson | 92/92 |
| 6,109,834 | A | * | 8/2000 | Chitwood | 405/223.1 |
| 6,422,533 | B1 | * | 7/2002 | Harms | 251/129.1 |
| 6,508,806 | B1 | | 1/2003 | Hoste | |
| 6,715,550 | B2 | * | 4/2004 | Vinegar et al. | 166/250.15 |
| 6,898,150 | B2 | * | 5/2005 | Hahn et al. | 367/85 |
| 6,944,935 | B2 | | 9/2005 | Hache | |
| 7,001,158 | B2 | * | 2/2006 | Dunn | 417/417 |
| 7,114,751 | B2 | | 10/2006 | Reynolds | |
| 7,188,678 | B2 | | 3/2007 | Bennett | |
| 7,219,745 | B2 | | 5/2007 | Mackay | |
| 7,373,972 | B2 | * | 5/2008 | Ocalan | 166/66.7 |

FOREIGN PATENT DOCUMENTS

| | | |
|---|---|---|
| EP | 213816 | 6/1991 |

OTHER PUBLICATIONS

Chou, A. and Philen, M., High-Performance Flexible Matrix Composite Actuators for Trailing Edge Flap Control, Virginia Polytechnic Institute and State University.*

Shan et al., Fluidic flexible matrix composites for autonomous structural tailoring, Department of Engineering, Pennsylvania State University, Apr. 3, 2007, University Park, Pennsylvania.*

* cited by examiner

FLEXIBLE MATRIX COMPOSITE ACTUATOR FOR USE IN SUBSURFACE WELLBORES

CROSS-REFERENCE TO RELATED APPLICATION

The present application claims the benefit of the filing date of U.S. Provisional Patent Application No. 60/825,158 filed Sep. 11, 2006.

BACKGROUND OF THE INVENTION

1. Field of the Invention

The invention relates generally to the field of actuators used in subsurface wellbores. More particularly, the invention relates to actuators using a wound fiber composite layer as an active element.

2. Background Art

Various types of actuators are used in wellbores drilled through subsurface formations. The actuators are used, for example to operate valves that control the flow of fluids into and out of the well. Actuators known in the art include, for example, electrically operated solenoids, motor and gear set combinations and hydraulic actuators (a piston disposed in a cylinder and controllably pressurized with hydraulic fluid or compressed gas). In certain circumstances it is desirable to control very large forces, such as pressure of fluid entering the wellbore from a subsurface formation, while minimizing the amount of control force needed to effect control.

Fiber composite materials are known in the art for a number of purposes, including shafts and rods, as well as fluid carrying conduits. Examples of the latter are disclosed, for example, in U.S. Pat. No. 6,620,475 issued to Reynolds, Jr. et al. Generally, a fiber composite material includes fiber arranged in a selected geometric pattern embedded in a "matrix" which may be plastic, cement, elastomer or other material that bonds to the fiber and provides structural integrity to the composite.

U.S. Pat. No. 4,877,375 issued to Desjardins discloses a flexible shaft made out of flexible matrix composites for use in helicopter applications. A rotor system disclosed in the '375 patent includes a structurally flexible rotor shaft for transmitting rotor torque and other rotor loads to a rotor hub. The rotor hub is configured to have rotor blades mounted thereon and is mounted by an elastomeric spherical bearing whose center is located at the rotor center. A flexible shaft made from fiber reinforced resin matrix material is connected to the rotor shaft at a connection located below the bearing center and extends vertically from that location through the bearing to a position located above the bearing center. There, the shaft is connected to a connecting member fixed to the upper surface of the rotor hub. The flexible shaft is structurally stiff with respect to the mode in which it transmits rotor torque compared to the rotor torque stiffness of the other components. However, the bending stiffness and axial stiffness of the flexible shaft is substantially less compared to the mode in which rotor moments and forces are transmitted from the other components to the rotor shaft.

U.S. Pat. No. 6,508,806 discloses guiding or angiography catheters, having a catheter shaft formed of a multi-layer wire reinforced wall construction consisting of one layer of wire wrapped in a substantially circumferential manner and another layer of wire laid at an angle of about 20 degrees to about 75 degrees with respect to the longitudinal axis of the tubular shaft.

European Patent No. 0 213 816 discloses a composite member and a method for making the composite member where such members may be made of flexible matrix material and stiff filamentary material wound at optimized angles to a longitudinal axis so that a maximum torsional to bending stiffness ratio is provided, while producing within the structural member the minimum possible bending stresses. The member is thereby able to carry larger loads. The disclosed structure provides members that are flexible in bending and in axial modes but stiff in torsional modes and produce low bending stresses. Such members are particularly suited for applications where torsional loads are to be transmitted and misalignment has to be accommodated.

It is also known in the art to use fiber composite materials as actuators. See, for example, Shan, Y., and Bakis, C. E., *Flexible Matrix Composite Actuators,* 20th Annual Technical Conference of American Society for Composites (ASC), Sep. 7-9, 2005, Philadelphia, Pa., which discloses flexible matrix composite actuators.

There continues to be a need for improved actuators for wellbore applications. It is desirable to apply the principles of flexible matrix composite actuators to making actuators for wellbore control applications.

SUMMARY OF THE INVENTION

A valve control system for a wellbore according to one aspect of the invention includes a fiber composite actuator functionally coupled to a valve operating member. The system includes means for controllably charging an interior of the actuator with fluid under pressure.

A valve for a wellbore according to another aspect of the invention includes a valve stem and a valve seat associated with a valve body. The valve stem and valve seat are configured to enable fluid flow from an inlet port in the valve body to an outlet port in the valve body when the stem is moved from the seat. An axial contraction fiber composite actuator is functionally coupled to the valve stem. The valve includes means for controllably charging an interior of the actuator with fluid under pressure.

A wellbore drilled through subsurface Earth formations according to another aspect of the invention includes a borehole drilled through the formations. A casing is disposed in the borehole to a selected depth. A tubing is disposed to a selected depth in the wellbore. The wellbore includes at least one valve disposed in the wellbore at a selected depth. The valve is configured to control fluid flow through at least one of the casing and the tubing. The valve includes a valve stem and a valve seat associated with a valve body. The valve stem and valve seat are configured to enable fluid flow from an inlet port in the valve body to an outlet port in the valve body when the stem is moved from the seat. The valve includes an axial contraction fiber composite actuator functionally coupled to the valve stem. The valve including means for controllably charging an interior of the actuator with fluid under pressure.

Other aspects and advantages of the invention will be apparent from the following description and the appended claims.

DETAILED DESCRIPTION

A valve and actuator according to the various aspects of the invention can include a fiber composite actuator that controls operation of the valve. Principles of operation of a fiber composite actuator are explained below. Following such explanation is a description of an example of valve and actuator that may have various uses in subsurface wellbores, and a non-limiting example of such use as a gas lift valve.

Long fiber composite laminae are layers of fiber embedded in a matrix material. Fiber composite laminae have anisotropic structural properties mainly due to the difference between the material properties of the fiber and the material properties of the matrix material. The amount anisotropy in any composite lamina depends primarily on the difference between the fiber stiffness and the matrix material stiffness. The effects obtained by the composite materials in the present invention are substantially dependent on such anisotropy. Therefore, practical implementations of an actuator made according to the invention can use flexible materials such as polyurethane and silicone rubber as the matrix material in the lamina to increase their effectiveness. Fibers in the lamina can be, as non limiting examples, synthetic fibers such as nylon, rayon, aramid or one sold under the trademark VECTRAN, which is a registered trademark of Hoechst Celanese Corp., New York, N.Y. It is only necessary that the fiber have greater stiffness than the matrix material in order for the actuator to work.

A composite tube may contain one more substantially cylindrical composite laminae wherein the fibers are wound along one or more selected winding angles with respect to the longitudinal axis of the tube. Depending on the winding angle, a particular type of actuation may take place when the matrix material is stressed, such as under hydraulic or pneumatic pressure applied to the interior of the tube.

Figure 1A:
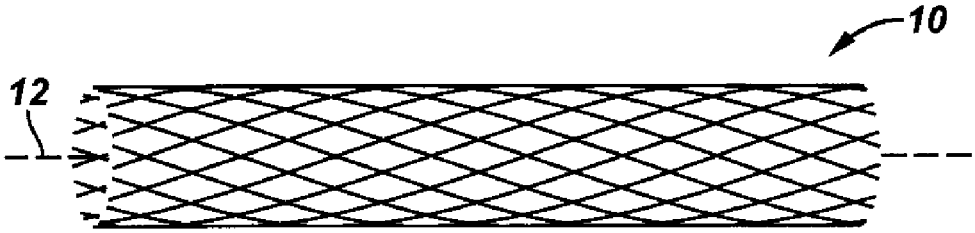
FIGS. 1A and B show an example of an axial retraction type actuator in extended (FIG. 1A) and retracted (FIG. 1B) positions.
Figure 1B:
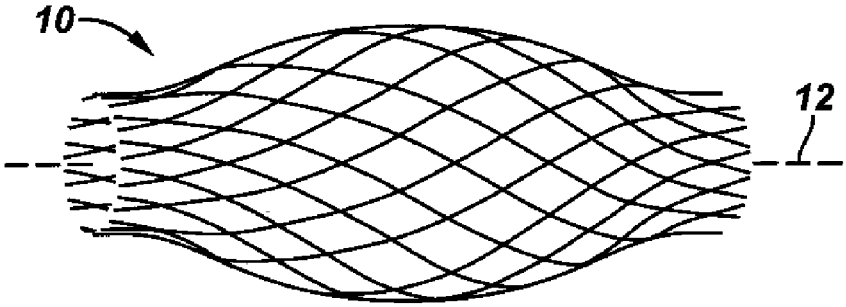

For example, an axial contraction actuator can be made when the fibers in a composite layer are wound so as to be aligned closely to the tube axis. Due to practical limitations in manufacturing of composites, winding angles of 15 to 20 degrees with respect to the tube axis are commonly used. Referring to FIG. 1A, the fiber layer 10 of an axial contraction actuator is shown to illustrate the principle. The matrix material is not shown in FIG. 1A for clarity of the illustration, but the fiber layer 10 is embedded in such matrix material, and as explained above, may be polyurethane, silicone rubber, or similar elastomer material. The fiber layer 10 has a wind angle of about 20 degrees with respect to the tube axis 12. The fiber layer 10 is shown in FIG. 1B after it is laterally (radially) expanded by application of hoop stress internally, such as by internally pressurizing the tube. Application of such hoop stress may be performed by inflating the composite tube or an internal bladder or reservoir with hydraulic or pneumatic pressure, as will be explained below in more detail with reference to FIG. 4. As can be observed in FIG. 1B, when the fiber layer 10 is laterally expanded under internal hoop stress, the axial length of the fiber layer (and thus the composite layer) is reduced. As hoop stress is applied, the relatively stiff fibers aligned closely with the axis 12 of the tube create a significant mechanical advantage in the axial contraction direction. It should also be noted that in FIGS. 1A and 1B the fiber thickness and the distance between fibers are magnified to illustrate the deflection.

Figure 2A:
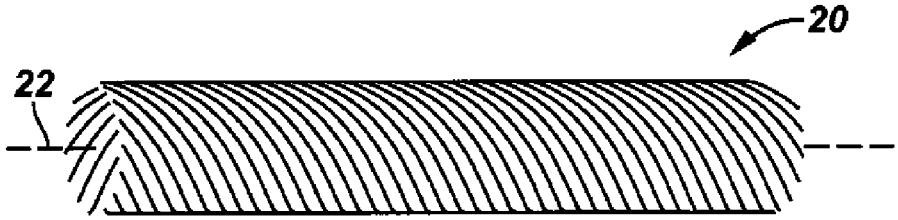
FIGS. 2A and 2B show an example of a torsional actuator in torsion and relaxed positions, respectively.
Figure 2B:
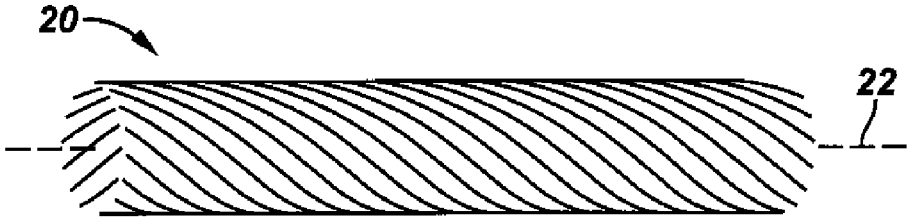

Referring to FIGS. 2A and 2B, a fiber composite torsional actuator has the fibers 20 wound at angles of about 55° with respect to the tube axis 22. At such winding angle, and if the fibers 20 are only wound in one direction, tensional hoop stress applied to the composite tube causes a torsion on the composite tube. The unstressed fiber layer 20 is shown in FIG. 2A, and the torsioned fiber layer is shown in FIG. 2B.

Figure 3A:
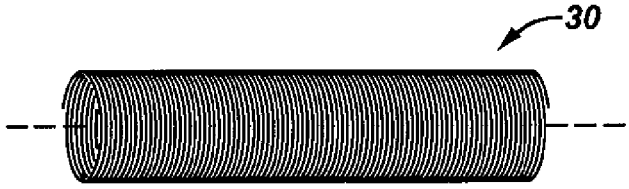
FIGS. 3A and 3B show an example of an axial extension actuator in retracted and extended positions, respectively.
Figure 3B:
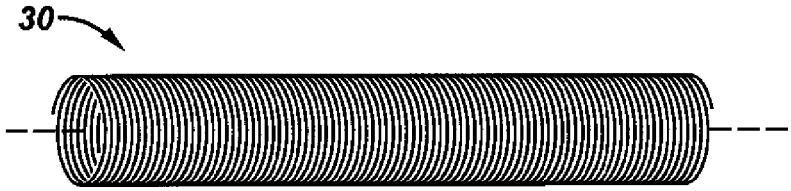

An example actuator shown in FIGS. 3A and 3B relies on the fibers 30 to strengthen the hoop direction by using close to a 90° winding angle with respect to the axis of the tube (shown in dashed lines). Along the axis of the tube, however, the effective Young's modulus of the tube is primarily governed by the matrix properties, but is relatively unaffected by the fibers in the fiber layer 30. Therefore, under internal pressure the actuator shown in FIGS. 3A (contracted) and 3B (expanded) extends longitudinally without significant hoop strain.

Figure 4:
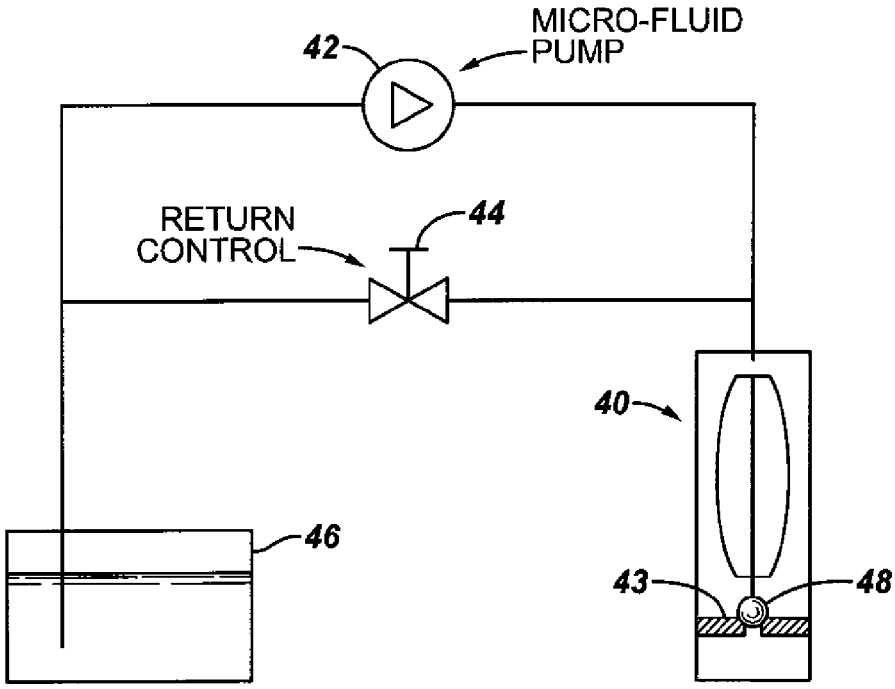
FIG. 4 shows an example hydraulic system used to operate an actuator such as shown with reference to FIGS. 1A and 1B.

In one example of a valve using a fiber composite actuator, and referring to FIG. 4, an axial contraction actuator 40 such as shown in FIGS. 1A and 1B is used in conjunction with an hydraulic pump 42 and a fluid return control valve 44. The actuator 40 controls a stem 48 normally pressed on to an orifice 43 by interference or a spring force. To open the valve shown in FIG. 4, hydraulic fluid is withdrawn from a reservoir 46 and is moved by the pump 42 into the interior of the actuator 40. As the interior of the actuator 40 is pressurized, the actuator 40 axially contracts, as explained with reference to FIGS. 1A and 1B, and thus lifts the stem 48 from the seat 43 to open the valve. During pressurization, the return control valve 44 is closed or presents a large restriction to return flow to the reservoir 46. To close the valve, the pump 42 is typically stopped and the return valve 44 is opened to enable the pressurized fluid inside the actuator 40 to return to the reservoir 46. The valve stem 48 may be returned to the seat 43 using a spring or similar biasing device (not shown) or may use the pressure of the fluid being controlled to move the stem 48 back into contact with the seat 43.

Figure 5:
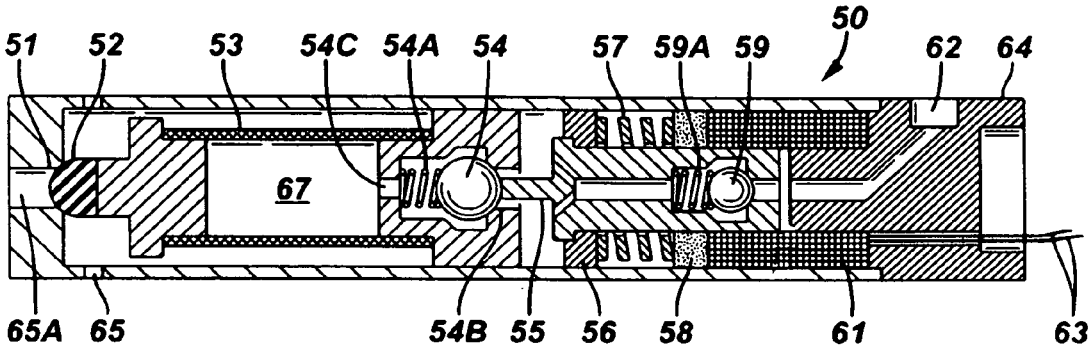
FIG. 5 shows an example hydraulic operated valve using an actuator according to the invention.

The example valve is shown in more detail in FIG. 5, which includes a cut away view of a complete valve system 50. The valve system 50 includes a fluid control valve, a fiber composite actuator functionally coupled to a valve operating device and an hydraulic control system to controllably charge the actuator.

A valve stem 52 may cooperatively engage with a valve seat 51 disposed within a valve body 64 to control movement of fluid through the valve system 50. When the valve is open, meaning that the stem 52 is lifted from the seat 51, fluid may flow between an inlet port 65 and an outlet port 65A. The stem 52 and seat 51 may be configured such that application of an interference force between the stem 52 and the seat 51 forms a seal and closes the valve to fluid flow between the inlet port 65 and the outlet port 65A. Such force may be a result of mechanical interference, or may be provided by a biasing device such as a spring (not shown) acting on the stem 52. Fluid pressure acting on the stem 52 may also urge the stem 52 into the seat 51.

An axial contraction actuator 53, which can be made as explained above with reference to FIGS. 1A and 1B and which may be disposed in the valve body 64, is attached at its output end to the stem 52, and to the inside of the valve body 64 at a check valve seat 54B on its other end. The actuator 53 may be made from one or more layers of fiber embedded in a flexible matrix and wound at an angle on the order of 20 degrees with respect to the actuator axis (see FIG. 1A). The actuator 53 defines a sealed chamber 67 therein for accumulation of hydraulic fluid under pressure inside the actuator 53. The chamber 67 may alternatively or additionally be sealed by inclusion of an elastomer bladder (not shown separately) therein. When fluid under pressure enters the chamber 67, it causes radial expansion of the actuator 53, and corresponding axial contraction of the actuator 53. Axial contraction of the actuator 53 lifts the stem 52 from the seat 51.

The movement of fluid into the chamber 67 can be controlled by an hydraulic control system as follows. An actuator check valve 54 disposed proximate the inlet to the chamber 67 can be biased by a spring 54A to open from the seat 54B when fluid pressure directed into the actuator chamber 67. When open, the actuator check valve 54 enables fluid to flow into the chamber 67 through port 54C. When the fluid pressure in the chamber 67 exceeds external hydraulic system pressure, and absent mechanical opening of the actuator check valve 54, the actuator check valve 54 closes against the seat 54B, trapping pressure in the chamber 67. Opening the actuator check valve 54 to release pressure in the chamber 67 will be further explained below.

A plunger 55 made from a magnetic material (for example, low carbon steel, etc.) is movably disposed within the valve body 64 and can have three longitudinal operating positions within the valve body 64. The operating positions are "pushed", "neutral" and "pulled." The plunger 55 is attached at one end to a spring retainer 56. The spring retainer 56 transmits force to the plunger 55 from a spring 57 disposed at one end of the spring retainer 56 inside the valve body 64. The spring 57 can be fixed at one end to the interior of the valve body 64 such as by an affixed magnet 58. Although illustrated as a single spring, to achieve the force requirements for any particular range of motion more than one spring may be used. A radially magnetized permanent magnet 58 is fixedly disposed inside the valve body 64 at the other end of the spring 57. A reciprocating check valve 59 is located inside the plunger 55. Similar in operation to the actuator check valve 54, the reciprocating check valve 59 can also be biased, such as by a spring 59A. Biasing springs, 54A for the actuator check valve 54 and 59A for the reciprocating check valve 59, are not essential to the operation of the hydraulic control system but may be included to improve the system performance. A solenoid 61 which may include tangentially wound insulated wire coils is located inside the valve body 64 on the other side of the magnet 58. A hydraulic fluid intake port 62 shown in FIG. 5 can be in hydraulic communication with the hydraulic fluid that is used to charge the actuator 53 (e.g. from reservoir 46 in FIG. 4).

When the valve system 50 is assembled as shown in FIG. 5, there are three main forces operating on the plunger 55. These forces are the magnetic force caused by the permanent magnet 58, magnetic force caused by the solenoid 61 when it is electrically energized (by applying power to leads 63) and spring force transferred through the spring retainer 56. Preferably, the force of the magnet 58 and the force exerted by the spring 57 are substantially the same when the plunger 55 is in its neutral position. Therefore, when the solenoid 61 is not actuated, the spring 57 force and the permanent magnet 58 force equalize and cause the plunger 55 to be in its neutral position. When the solenoid 61 is activated to induce a static magnetic field of the same field polarity as the magnet 58, the total magnetic force overcomes the force exerted by the spring 57 and moves the plunger 55 into its "pulled" position. When the solenoid is activated in the opposite electrical polarity, the magnetic field induced by the magnet 58 and the solenoid 61 substantially cancel each other in the plunger 55, and the plunger 55 is then moved to its "pushed" position by the spring 57. The above-mentioned "positive" and "negative" polarity is not intended to determine an absolute electrical polarity of the solenoid leads 63 but is presented to distinguish between the polarity that causes the solenoid 61 to generate magnetic flux aligned with or opposed to the permanent magnet 58 flux.

A dynamic seal between the outer surface of the spring retainer 56 and the inner surface of valve body 64 is designed to have relatively small leakage rate while the plunger 55 is in either the neutral or the pulled positions. In the pushed position, however, the dynamic seal between the valve body 64 and the spring retainer 56 is configured to leak at a selected rate. Such selected rate leakage can be attained, for example, by machining flow passageways that are blocked in the neutral and pulled positions and exposed in the pushed position. Similarly, an undercut on the valve body 64 or on the valve body 64 and in the spring retainer 56 may be designed for this purpose.

When the plunger 55 is moved from the neutral to the pulled position, the volume of fluid between the spring retainer 56 and valve body 64 is increased and thus the pressure of the fluid decreased. This pressure drop opens the reciprocating check valve 59 and enables fluid flow into the interior of the plunger 55 (from the reservoir 46 in FIG. 4). When the plunger 55 is released to the neutral position from the pulled position, the fluid pressure in the plunger 55 is increased due to the spring 57 force. The increase in pressure causes the actuator check valve 54 to open and enables fluid to flow into the actuator chamber 67. Therefore, by reciprocating the plunger 55 from the pulled position to the neutral position, fluid is made to flow into the actuator chamber 67 and thus charges the chamber 67. Reciprocating the plunger 55 may be performed by alternately energizing (to the same polarity) and de-energizing the solenoid 61. As discussed above the charged actuator 53 axially contracts to apply a pulling force on the stem 52 and opens the valve 50 to fluid flow between the inlet port 65 and the outlet port 65A.

When the plunger 55 is forced to the pushed position by appropriate operation of the solenoid 61, the plunger 55 moves the actuator check valve 54 into its open position. In addition, in the pushed position the dynamic seal between the spring retainer 56 and the valve body 64 is opened to expose the selected leak rate features (not shown). Therefore, when the plunger 55 is in the pushed position, the fluid inside the actuator chamber 67 is free to move back through the interior of the valve body 64, through the solenoid area inside the valve body 64 and back into the fluid intake 62. When the fluid inside the actuator chamber 67 is released, fluid pressure acting through the inlet port 65 urges the stem 52 toward the seat 51. Because the chamber 67 is free to deflate, the hoop stress in the actuator 53 is relieved and the actuator 53 lengthens under the tension provided by action of the fluid pressure on the stem 52. The valve (stem 52 and seat 51) thus closes. Closing motion of the stem 52 may be assisted by a spring (not shown).

Figure 6:
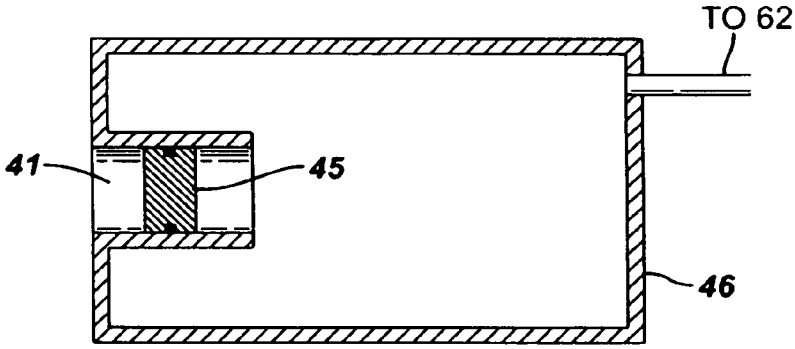
FIG. 6 shows an example of a pressure compensation device for the hydraulic fluid reservoir.

Hydraulic fluid to operate the valve system 50 can be supplied from a variety of sources. To minimize the power requirements of the solenoid 61, the pressure of the fluid at the inlet 62 should be kept close to the fluid pressure at the valve inlet port 65. Maintaining the appropriate static hydraulic fluid pressure may be performed by using a pressure compensator such as a bellows, a piston, a flexible tube or a flexible bag or other movable barrier exposed on one side the hydraulic fluid and on the other side to the fluid pressure being controlled. Advantageously, a valve and actuator system made as shown in FIG. 5 may provide substantial force to open the valve while using very little hydraulic pressure. One example of a pressure compensation device is shown in FIG. 6, wherein the reservoir 46 includes a fluid pressure communication port 41 through a wall thereof. A piston 45 is slidably placed in the port 41. Pressure outside the reservoir 46 is communicated to the interior of the reservoir 46 by motion of the piston 45, thus maintaining fluid pressure in the reservoir 46 substantially at the same pressure as outside the reservoir 46.

Figure 7:
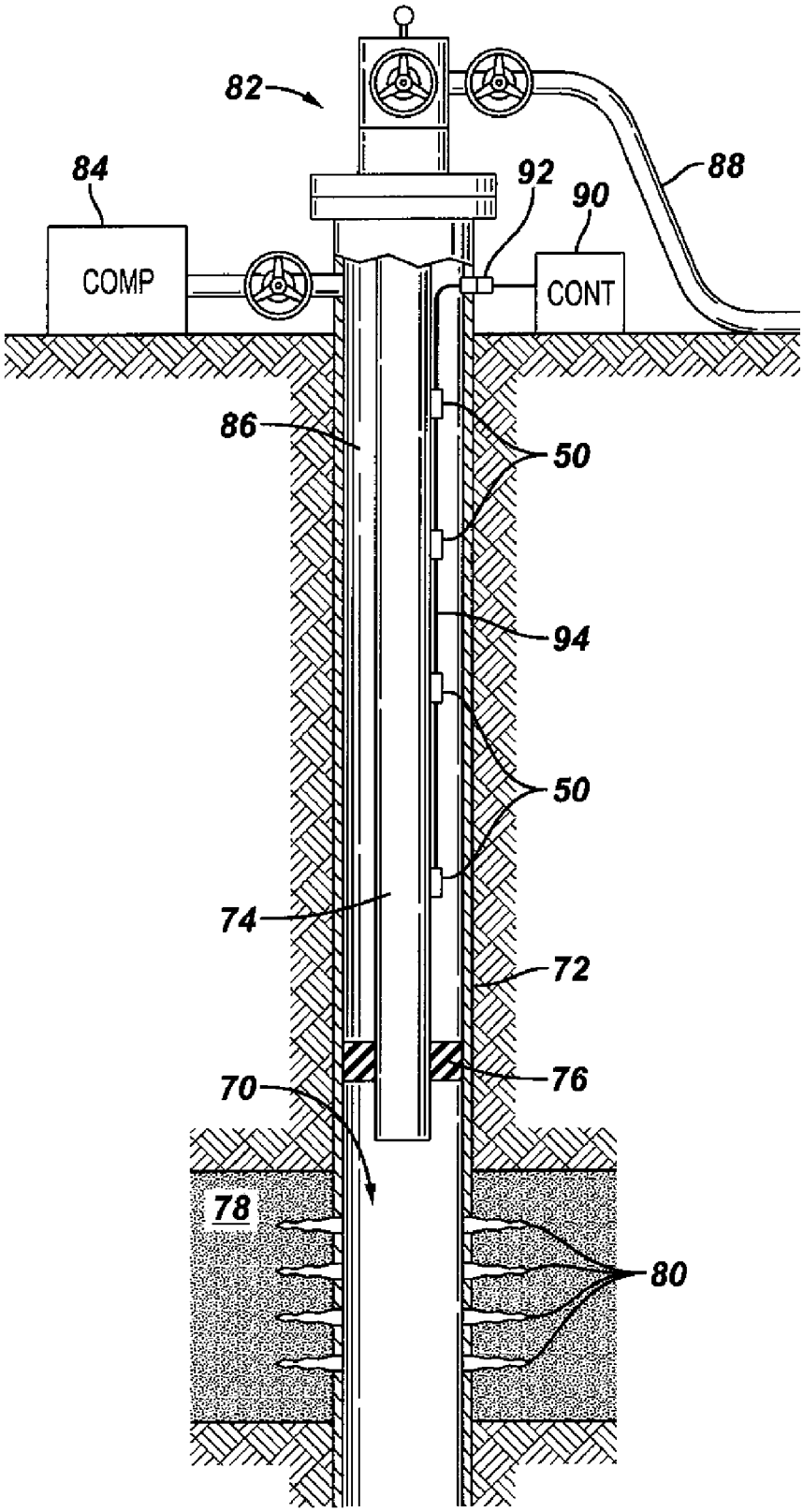
FIG. 7 shows one example application of a valve system as a gas lift valve.

One application for the valve system shown in FIG. 5 is shown in FIG. 7. A wellbore 70 is drilled through subsurface formations including an oil producing formation 78. The wellbore includes a casing 72 disposed therein. Perforations 80 through the casing 72 proximate the oil producing formation 78 enable fluid in such formation 78 to enter the casing 72. A production tubing 74 is disposed in the wellbore 70 to a selected depth, typically shallower than the perforations 80. An annular space 86 between the tubing 74 and the casing 72 may be sealed using a packer 76 or similar seating element. The tubing 74 and casing 72 typically terminate at the Earth's surface in a wellhead 82 that includes various valves to control fluid entry into the annular space 86 and fluid movement out of the tubing 74 into a flow line 88. The tubing 74 may include at spaced apart positions along its exterior one or more valve systems 50 as explained above with reference to FIG. 5. Each valve system 50 may include a pressure compensated fluid reservoir associated therewith and as explained with reference to FIG. 6. The valve systems 50 controllably enable pressurized gas in the annular space 86, supplied by a compressor 84 at the surface, to enter the interior of the tubing 74. Operation of the valve systems may be performed by a control unit 90 at the Earth's surface that transmits control signals over a control line 94 connected to the solenoid (61 in FIG. 5) of each valve system 50. Connection between the control unit 90 and the control line 94 may be made using an electromagnetic coupling 92 disposed in or proximate the wellhead 82. Alternatively, a separate control unit (not shown) may be associated with each valve system 50. A controller, such as a microprocessor or programmable logic controller, may be disposed in the control unit 90 (or associated with one of the valve systems) for creating the control signal necessary to energize the solenoid and thus charge and discharge the actuator.

The configuration shown in FIG. 7 has the valve systems performing the function of "gas lift" valves, wherein gas is controllably conducted to the interior of the tubing 74 to buoyantly lift liquid (typically a mixture of oil and water) in the tubing 74 to the Earth's surface. It should be clearly understood that the application of the valve system shown in FIG. 7 is only one example of application of a valve system according to the invention. Other applications may include, without limitation "intelligent completion" valves, zonal isolation valves, injection control valves and downhole oil-water separator control valves.

Other examples may include a torsional fiber composite actuator as explained above with reference to FIGS. 2A and 2B, wherein the valve operating element may be a cylindrical sleeve having a port therein, which rotates concentrically inside the valve body (e.g., 64 in FIG. 5). The valve body may also have a port therein, such that rotation of the valve operating element sleeve to align its port with the port in the valve body opens the valve. Rotation of the valve operating element may be performed by charging the interior of the torsional actuator. A torsional spring or similar device may rotate the valve operating element in the opposite direction to close the valve when the actuator is discharged.

A valve system made according to the various aspects of the invention may provide the capability to control relatively high forces using only relatively small amounts of control force. Such valve systems may be relatively compact, reliable and easy to manufacture and maintain.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A valve control system for a wellbore, comprising:

a fiber composite actuator functionally coupled to a valve operating member;

a plunger disposed in a valve body to controllably charge an interior of the actuator with fluid under pressure; and a mechanism having a spring, a magnet and a solenoid disposed within the valve body to reciprocate the plunger within the valve body, the spring arranged to transmit its force to the plunger and react its force against the valve body, the magnet arranged to urge the plunger in a selected direction along the interior of the valve body opposed to the direction of the spring force, the solenoid arranged to produce a magnetic field at least one of opposed to and aligned with a magnetic field induced by the magnet.

2. The system of claim 1 wherein the actuator comprises a fiber layer wound at a selected angle with respect to a longitudinal axis of the actuator, the fiber layer disposed in a flexible matrix.

3. The system of claim 2 wherein the selected angle is such that the actuator axially contracts when the interior of the actuator is charged with fluid under pressure.

4. The system of claim 3 wherein the selected angle is about 20 degrees with respect to a longitudinal axis of the actuator.

5. The system of claim 1 further comprising check valves associated with the plunger, the check valves arranged such that reciprocation of the plunger urges fluid into the interior of the actuator.

6. The system of claim 5 wherein one of the check valves and the plunger are configured such that plunger motion along a selected direction opens the one check valve to enable release of fluid from the interior of the actuator.

7. The system of claim 1 wherein the valve operating member comprises a valve stem coupled to one end of the actuator.

8. The system of claim 1 further comprising a pressure compensated reservoir.

9. A valve for a wellbore, comprising:

a valve stem and a valve seat associated with a valve body, the valve stem and valve seat configured to enable fluid flow from an inlet port in the valve body to an outlet port in the valve body when the stem is moved from the seat;

an axial contraction fiber composite actuator functionally coupled to the valve stem; and a mechanism to controllably charge an interior of the actuator with fluid under pressure.

10. The valve of claim 9 wherein the actuator comprises a fiber layer wound at a selected angle with respect to a longitudinal axis of the actuator, the fiber layer disposed in an elastomer matrix.

11. The valve of claim 10 wherein the selected angle is about 20 degrees with respect to a longitudinal axis of the actuator.

12. The valve of claim 9 wherein the mechanism to controllably charge comprises a plunger disposed in the valve body, and a reciprocating mechanism to reciprocate the plunger within the valve body.

13. The valve of claim 12 wherein the reciprocating mechanism comprises a spring, a magnet and a solenoid disposed within the valve body, the spring arranged to transmit its force to the plunger and react its force against the valve body, the magnet arranged to urge the plunger in a selected direction along the interior of the valve body opposed to the direction of the spring force, the solenoid arranged to produce a magnetic field at least one of opposed to and aligned with a magnetic field induced by the magnet.

14. The valve of claim 12 further comprising check valves associated with the plunger, the check valves arranged such that reciprocation of the plunger urges fluid into the interior of the actuator.

15. The valve of claim 14 wherein one of the check valves and the plunger are configured such that plunger motion along a selected direction opens the one check valve to enable release of fluid from the interior of the actuator.

16. The valve of claim 9 further comprising a pressure compensated reservoir.

17. A wellbore penetrating subsurface Earth formations, comprising:

a borehole formed through the formations;

a casing disposed in the borehole to a selected depth;

a tubing disposed to a selected depth within the casing; and at least one valve disposed in the wellbore at a selected depth; the valve configured to control fluid flow through at least one of the casing and the tubing, the valve including a valve stem and a valve seat associated with a valve body, the valve stem and valve seat configured to enable fluid flow from an inlet port in the valve body to an outlet port in the valve body when the stem is moved from the seat, the valve including an axial contraction fiber composite actuator functionally coupled to the valve stem, the valve including a mechanism that is selectively movable to control charging of an interior of the actuator with fluid under pressure.

18. The wellbore of claim 17 wherein the actuator comprises a fiber layer wound at a selected angle with respect to a longitudinal axis of the actuator, the fiber layer disposed in an elastomer matrix.

19. The wellbore of claim 18 wherein the selected angle is about 20 degrees with respect to a longitudinal axis of the actuator.

20. The wellbore of claim 17 wherein the mechanism comprises a plunger disposed in the valve body.

21. The wellbore of claim 20 further comprising a spring, a magnet and a solenoid disposed within the valve body, the spring arranged to transmit its force to the plunger and react its force against the valve body, the magnet arranged to urge the plunger in a selected direction along the interior of the valve body opposed to the direction of the spring force, the solenoid arranged to produce a magnetic field at least one of opposed to and aligned with a magnetic field induced by the magnet.

22. The wellbore of claim 20 further comprising check valves associated with the plunger, the check valves arranged such that reciprocation of the plunger urges fluid into the interior of the actuator.

23. The wellbore of claim 17 further comprising a pressure compensated reservoir.

* * * * *